United States Patent [19]

Marquis

[11] 4,100,381

[45] Jul. 11, 1978

[54] ELECTRICAL SWITCH CONSTRUCTION AND METHOD OF MAKING THE SAME

[75] Inventor: Edgar E. Marquis, Newtown, Conn.

[73] Assignee: Robertshaw Controls Company, Richmond, Va.

[21] Appl. No.: 742,756

[22] Filed: Nov. 18, 1976

[51] Int. Cl.[2] ..... H01H 43/10

[52] U.S. Cl. ..... 200/38 A; 200/38 FB; 200/38 D; 200/39 R

[58] Field of Search ..... 200/38 A, 38 F, 38 FA, 200/38 FB, 38 BA, 39 R, 39 A, 153 L, 153 LB

[56] References Cited

U.S. PATENT DOCUMENTS

| | | | |
|---|---|---|---|
| 2,920,153 | 1/1960 | Horstmann | 200/153 L X |
| 3,699,281 | 10/1972 | Harris | 200/39 R X |
| 3,846,597 | 11/1974 | Ziegler, Jr. | 200/38 BA |
| 3,925,630 | 12/1975 | Harris | 200/39 R |
| 3,950,624 | 4/1976 | Harris | 200/39 R |
| 3,965,312 | 6/1976 | Mahon | 200/39 R |
| 3,997,742 | 12/1976 | Marquis | 200/38 FB |
| 4,001,529 | 1/1977 | Mahon | 200/39 R |

*Primary Examiner*—James R. Scott

*Attorney, Agent, or Firm*—Candor, Candor & Tassone

[57] ABSTRACT

An electrical switch construction having an electrical switch provided with different operating conditions, the construction having a timer moved actuator operatively associated with the switch for causing the switch to be repetitively in one condition thereof a certain percentage of a certain increment of time and in another condition thereof for the remainder of the certain increment of time. The actuator is adapted for selecting the amount of the certain percentage of the certain increment of time within certain limits.

10 Claims, 11 Drawing Figures

ELECTRICAL SWITCH CONSTRUCTION AND METHOD OF MAKING THE SAME

BACKGROUND OF THE INVENTION

This invention relates to an improved electrical switch construction and to a method of making the same as well as to a microwave oven utilizing such an electrical switch construction.

SUMMARY OF THE INVENTION

It has been found desirable to operate the power unit of a microwave oven in a repetitive on-off manner to provide a defrosting cycle for frozen food disposed therein before the subsequently thawed food is actually cooked by the oven.

Accordingly, it is a feature of this invention to provide an electrical switch construction which can be selectively set for providing a repetitive on-off action whereby the switch construction will be in one operating condition thereof a certain percentage of a certain increment of time and be in another operating condition thereof for the remainder of that certain increment of time.

Such a switch construction of this invention can be utilized with a microwave oven to provide for a deforst cycle thereof because the operator can select a high percentage of on time for the power unit of the microwave oven for a fast defrost cycle with such a switch construction or select a low percent of on time for a slower defrost cycle thereof.

In particular, one embodiment of this invention provides an electrical switch construction having an electrical switch provided with different operating conditions, the switch construction having means operatively associated with the switch for causing the switch to be repetitively in one condition thereof a certain percentage of a certain increment of time and for being in another condition thereof for the remainder of the certain increment of time. Such means is adapted for selecting the amount of the certain percentage of the certain increment of time within certain limits such as from about 30 percent "on" time and 70 percent "off" time all the way up to 100 percent "on" time, as desired.

Accordingly, it is an object of this invention to provide an improved electrical switch construction having one or more of the novel features of this invention as set forth above or hereinafter shown or described.

Another object of this invention is to provide a method of making such an electrical switch construction, the method of this invention having one or more of the novel features of this invention as set forth above or hereinafter shown or described.

Another object of this invention is to provide a microwave oven utilizing such an electrical switch construction.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
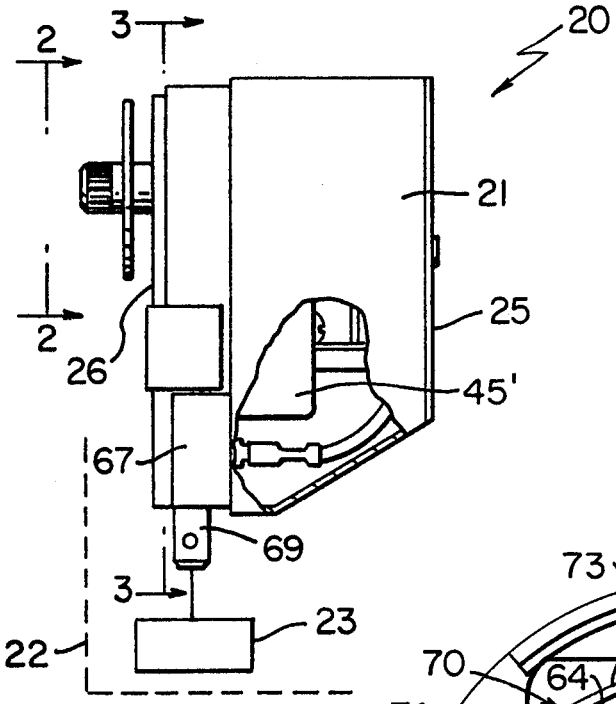
FIG. 1 is a side view partially broken away illustrating the improved electrical switch construction of this invention, FIG. 1 schematically illustrating the electrical switch construction in a microwave oven.

While the various features of this invention are hereinafter described and illustrated as being particularly adapted to provide a variable on time switch construction for a microwave oven, it is to be understood that the various features of this invention can be utilized singly or in any combination thereof to provide an electrical switch construction for other devices as desired.

Therefore, this invention is not to be limited to only the embodiment illustrated in the drawings, because the drawings are merely utilized to illustrate one of the wide variety of uses of this invention.

Figure 2:
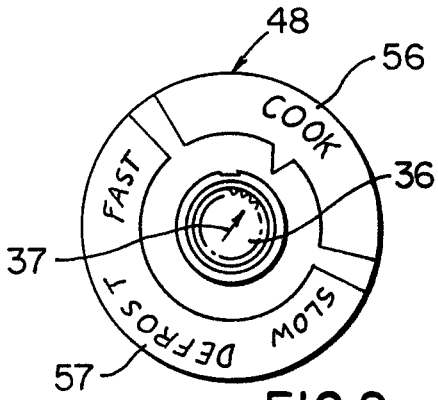
FIG. 2 is an enlarged front view of the selector shaft and dial of the electrical switch of FIG. 1 and taken substantially in the direction of the arrows 2—2 of FIG. 1.
Figure 3:
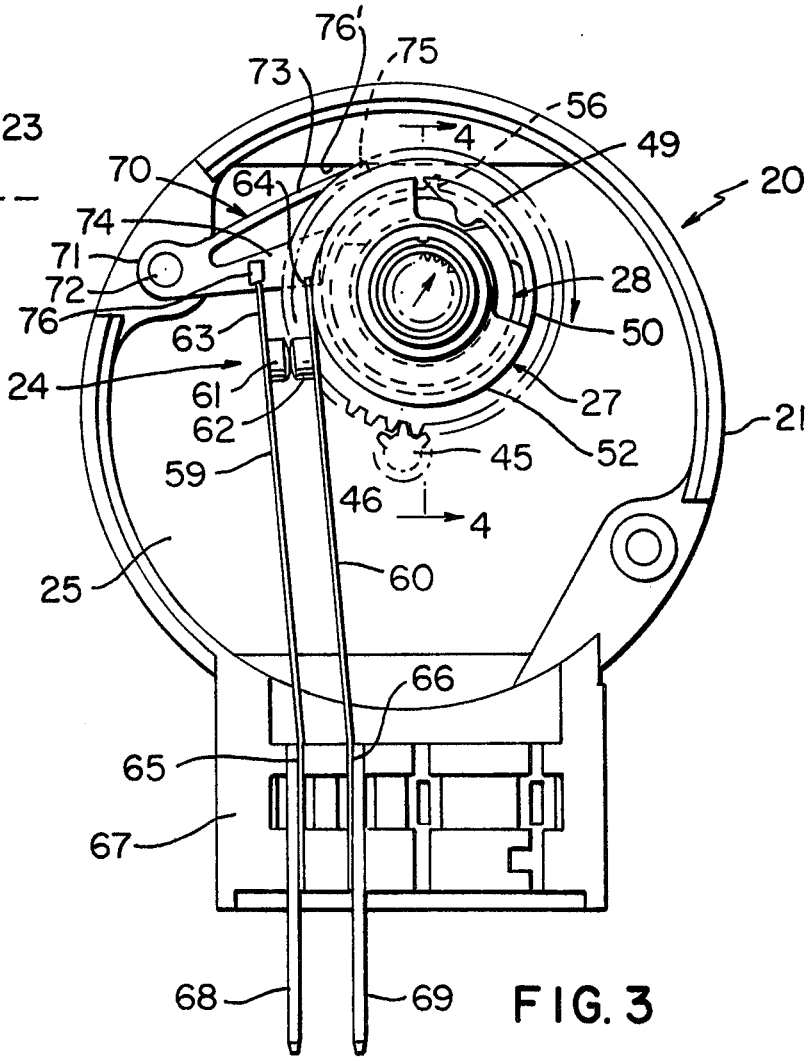
FIG. 3 is an enlarged front view of the switch construction of FIG. 1 and is taken in the direction of the arrows 3—3 of FIG. 1.

Referring now to FIGS. 1, 2 and 3, the improved electrical switch construction of this invention is generally indicated by the reference numeral 20 and comprises a housing means 21 adapted to be secured to the frame structure of a microwave oven that is schematically illustrated in FIG. 1 by the dashed lines 22, the microwave oven 22 containing the conventional power unit 23 therefor for providing a microwave oven cooking operation in a manner well known in the art when the power unit 23 is electrically interconnected to a suitable power source (not shown) under the control of an electrical switch of the switch construction 21 that is generally indicated by the reference numeral 24 in FIG. 3.

In particular, when the electrical switch 24 is in the closed condition of FIG. 3 in a manner hereinafter described, the electrical switch construction 21 is adapted to cause the power source to be interconnected to the power unit 23 of the microwave oven 22 so that the power unit 23 can provide its cooking or thawing function as will be apparent hereinafter.

However, when the electrical switch 24 is in the open condition of FIG. 10 in a manner hereinafter described, the power source is disconnected from the power unit 23 of the oven 22 to thereby terminate the cooking and/or thawing operation as will be apparent hereinafter.

Figure 5:
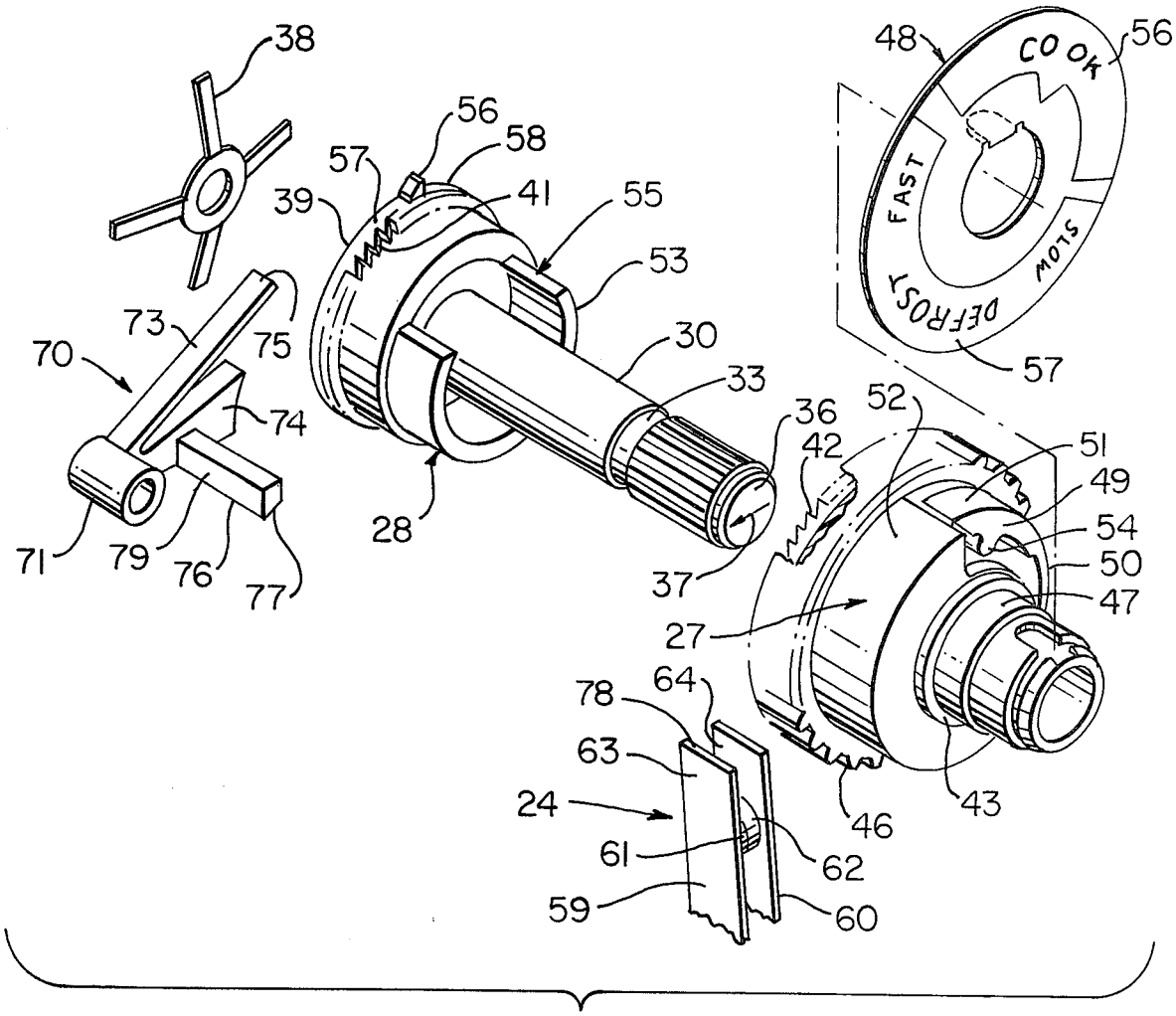
FIG. 5 is an exploded perspective view of the parts of FIG. 4.
Figure 4:
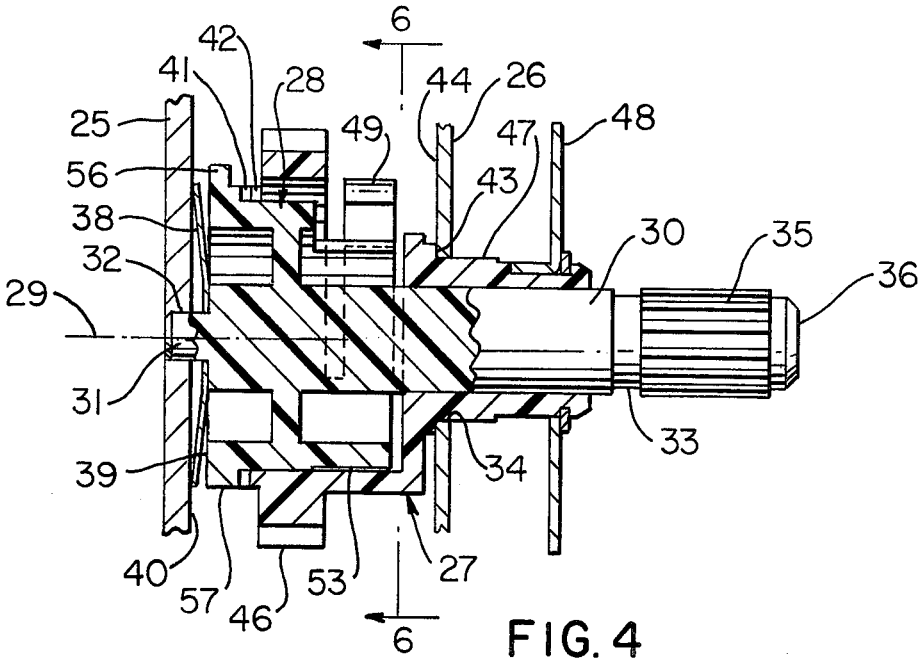
FIG. 4 is an enlarged cross-sectional view taken on line 4—4 of FIG. 3.

As illustrated in FIGS. 3, 4 and 5, the housing means 21 has a back plate 25 and a front plate 26 between which a cam member 27 and an unlocking member 28 are rotatably mounted to rotate in unison about the same axis which is represented by dashed lines 29 in FIG. 4.

The unlocking member 28 includes a shaft-like portion 30 that has a reduced end 31 received in an opening 32 in the rear plate 23, the shaft 30 having a front portion 33 that projects out through an opening 34 of the front plate 26 and is provided with a knurled surface 35 for attaching to a suitable selector knob (not shown).

For illustrative purposes, the front face 36 of the shaft 30 of the unlatching member 28 has an arrow 37 thereon for indicating the various settings of the switch construction 20 as will be apprent hereinafter.

A star-like leaf spring 38 is telescoped onto the reduced extension 31 of the shaft 30 of the unlatching member 38 to bear respectively against an enlarged end surface 39 of the unlatching member 28 and the front surface 40 of the rear plate 25 to tend to urge the member 28 to the right in FIG. 4 and thereby tend to maintain an annular arrangement of gear teeth 41 thereof in engagement with an annular arrangement of grear teeth 42 on the cam member 27 while also forcing a surface or shoulder 43 of the cam member 27 into engagement against the inside surface 44 of the front plate 26 as illustrated in FIG. 4. In this manner, the members 27 and 28 are adapted to be rotated in unison in a manner hereinafter described about the axis 29 when the cam member 27 is rotated by a drive gear 45, FIG. 3, disposed in meshing engagement with a ring gear arrangement 46 formed on the cam member 27, the drive gear 45 being secured to the output shaft of a suitable timer motor 45' that is illustrated in FIG. 1.

The cam member 27 is telescoped onto the unlatching member 28 and has a forward tubular portion 47 that telescopically receives the shaft portion 30 of the unlatching member 28 to rotatably mount the same while the tubular portion 47 has a fixed dial plate 48 thereon to rotate in unison with the cam member 27 as will be apparent hereinafter.

Figure 6:
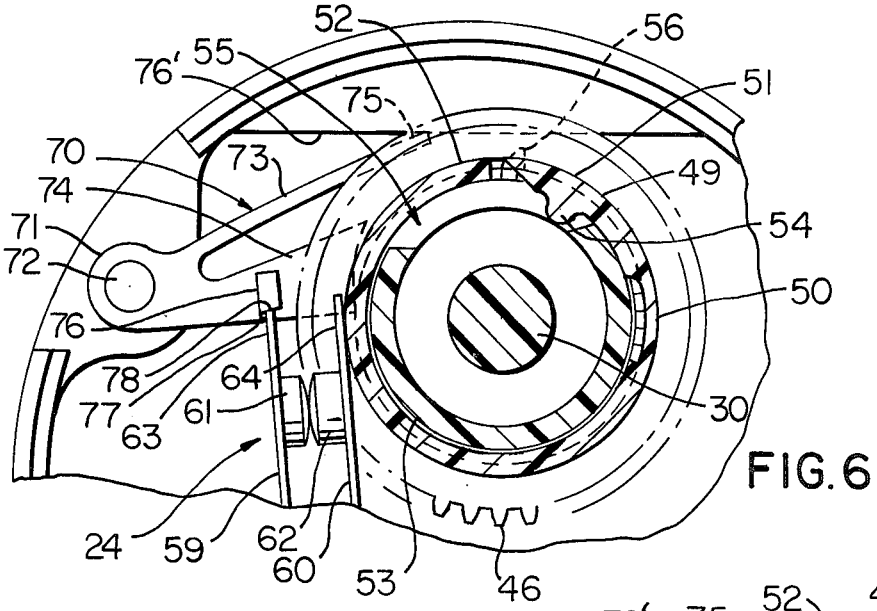
FIG. 6 is a fragmentary cross-sectional view taken on line 6—6 of FIG. 4.
Figure 7:
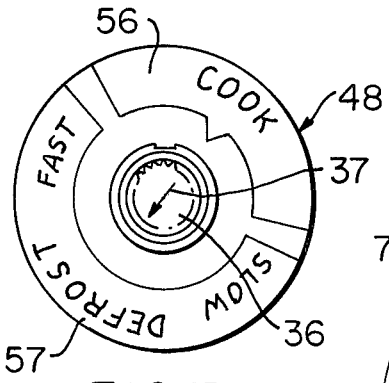
FIG. 7 is a view similar to FIG. 2 and illustrates the selector shaft for the switch construction set in another operating position thereof.
Figure 8:
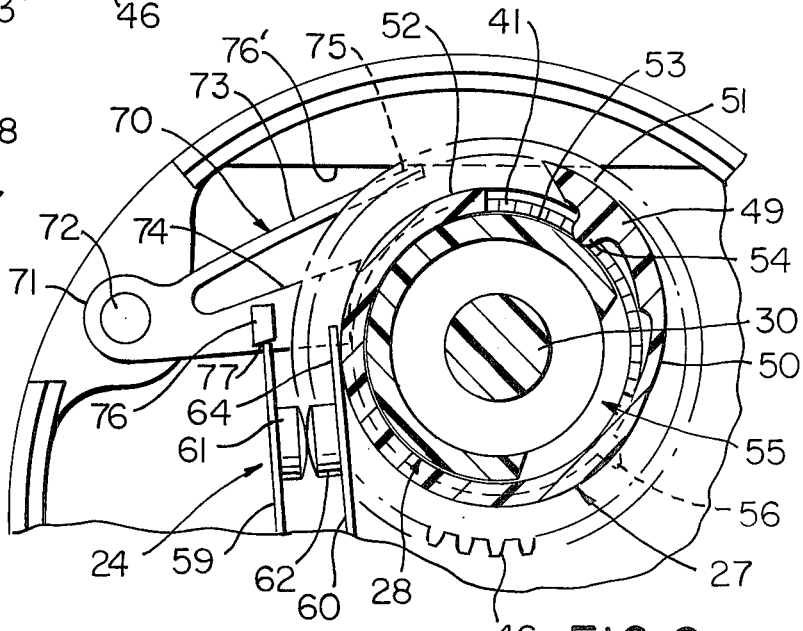
FIG. 8 is a view similar to FIG. 6 and illustrates the electrical switch construction when set for the condition of FIG. 7.

The cam member 27 is formed from suitable plastic material and has a cam part 49 that is integrally hinged to the remainder of a cam member 27 at a joint area 50 as illustrated in FIGS. 6 and 8 with the hinged area 50 having a natural resiliency to hold the cam member 49 in the in position of FIG. 6 so that the outer surface 51 of the cam part 49 will define part of a cylindrical section 52 of the cam member 27. However, when the unlatching member 28 is rotated relative to the cam member 27 from the position of FIG. 6 into the position of FIG. 8, a cam surface 53 of the unlatching member 28 engages against a rib 54 of the cam part 49 of the cam member 27 and cams the same outwardly to the out position of FIG. 8 for a purpose hereinafter described, the cam surface 53 of the unlatching member 28 being substantially a cylindrical section of the unlatching member 28 that is cut away in the region of the reference numeral 55 of FIG. 6 to permit the cam part 49 of the cam member 27 to return to the "in" position of FIG. 6 when the cutout 55 is aligned with the rib 54 of the cam part 49. In this position of the unlatching member 28 relative to the cam member 27, it can be seen that the pointer 37 on the shaft 30 of the unlatching member 28 is pointing to a "cook" section 56 on the dial plate 48 of the unlatching member 27 as illustrated in FIG. 2 whereas when the pointer 37 is pointing to the "defrost" section 57 of the dial plate 48 as illustrated in FIG. 7, the cam section 53 of the unlatching member 28 is in a position to cam against the rib 54 of the cam part 49 of the cam member 47 to hold the same in the out position of FIG. 8 for the purpose hereinafter described.

The unlatching member 28 has an outwardly directed unlatching tang 56 disposed on the outer periphery 57 of an end disc-like portion 58 thereof for a purpose hereinafter described.

The electrical switch 24 of the switch construction 21 comprises a pair of flexible switch blades 59 and 60 best illustrated in FIG. 3 and respectively carrying electrical contacts 61 and 62 at the free ends 63 and 64 thereof which are normally adapted to be disposed in electrical contact with each other by the natural resiliency of the switch blades 59 and 60 which respectively have the lower ends 65 and 66 thereof secured in cantilever fashion to a terminal block section 67 of the housing means 21. In this manner, a pair of rigid terminals 68 and 69 are respectively disposed in electrical contact with the switch blades 59 and 60 at the ends 65 and 66 thereof and project outwardly from the terminal block 67 so as to be coupled in to the desired electrical circuit for controlling the power unit 23 of the microwave oven 22 for the reasons previously set forth and hereinafter further described.

Figure 9:
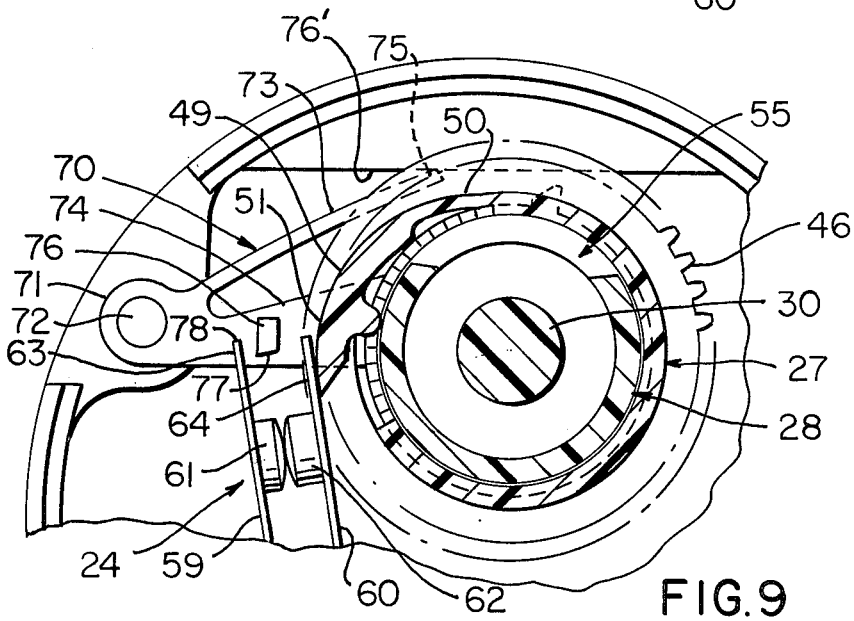
FIG. 9 is a view similar to FIG. 8 and illustrates the switch construction in another operating condition for the setting of FIG. 7.

Not only do the switch blades 59 and 60 have a natural resiliency to place the contacts 61 and 62 into contact with each other as illustrated in FIG. 3, but also the natural resiliency of the combined switch blades 59 and 60 is to place the end 64 of the switch blade 60 into engagement with the cylindrical surface 52 of the cam member 27 so that as the cam member 27 is rotated about the axis 29, the end 64 of the switch blade 60 remains against the cam surface 52 and the switch blades 59 and 60 remain in the closed condition of FIG. 3 as long as the cam part 49 is in the "in" condition of FIG. 6 whereby during each revolution of the cam member 27, there is no change in the closed condition of the switch 24. However, when the cam part 49 of the cam member 27 is cammed to the "out" condition of FIG. 8 through the changing of the relative positions of the unlatching member 28 and the cam member 27, each time the cam part 49 is rotated to contact the end 64 of the blade 60 in the manner illustrated in FIG. 9, the blades 59 and 60 are cammed to the left as illustrated in FIG. 9 for a purpose hereinafter described to cause the switch 24 to assume the open condition as illustrated in FIG. 10.

Figure 10:
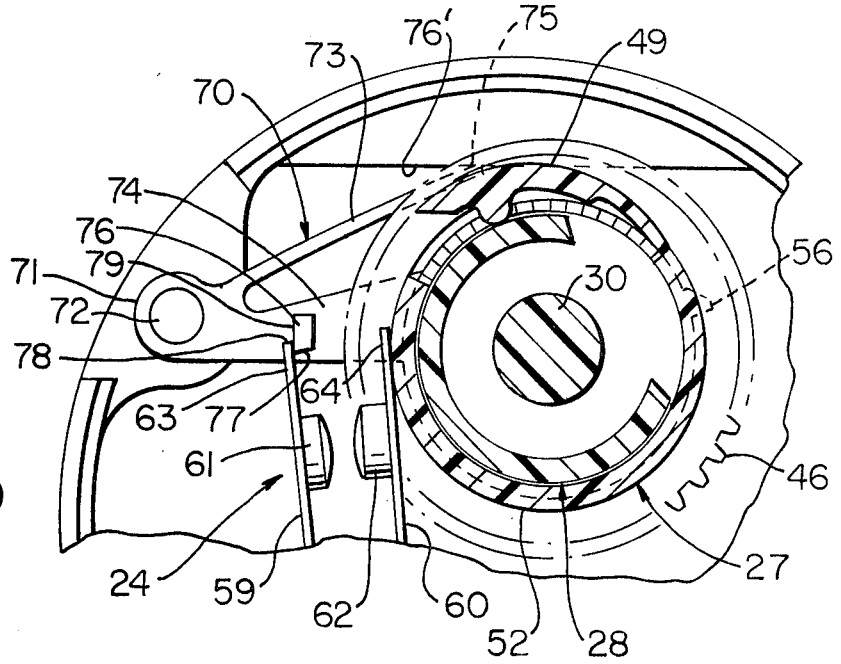
FIG. 10 is a view similar to FIG. 8 and illustrates the switch construction in another operating condition for the setting of FIG. 7.

In order to hold the switch 24 in the open condition of FIG. 10, a latching member for the switch construction 21 is provided and is generally indicated by the reference numeral 70, the latching member 70 having a tubular part 71 which telescopes onto a cylindrical mounting post 72 of the housing means 21 to rotatably mount the latching member 70 to the housing means 21.

The latching member 70 has a pair of diverging arms 73 and 74 radiating from the tubular part 71 with the arm 73 being relatively flexible and having a free end 75 that bears against a shoulder 76' of the housing means 21 for a purpose hereinafter described. The arm 74 has an outwardly directed locking extension 76 provided with an angled surface 77 which is adapted to engage against the end edge 78 of the free end 63 of the switch blade 59 when the switch 24 is in the closed condition of FIG. 3. In this condition of the switch 24, the latch member 70 is pushed or rotated upwardly in FIG. 3 by the end edge 78 of the blade 59 engaging against the angled surface 77 of the latch projection 76 so that the arm 73 is flexed and thereby stores energy tending to rotate the latch member 70 and, thus, the arm 74 of the latch member 70 to the normal position of FIG. 10 wherein the latch projection 76 would normally be disposed between the switch blades 59 and 60 for a latching operation as will be apparent hereinafter.

Thus, it can be seen that the switch construction 21 of this invention can be made according to the method of this invention in a simple and effective manner from a relatively few parts to provide for a variable on time of the power unit 23 of the microwave oven 22 in a manner now to be described.

When the operator sets the selector shaft 30 of the unlatching member 28 to the desired position relative to the cam member 27 by rotating the shaft 30 in a clockwise direction whereby the shape of the gear teeth 41 on the unlatching member 28 and the shape of the teeth 42 on the cam member 27 will permit such ratcheting relative to each other and through the compression of the leaf spring 38 permitting such axial movement between the members 27 and 28, the desired rotational position of the unlatching member 28 relative to the cam member 27 can be selected. For example, should the operator desire a continuous cooking operation for the oven 22, the operator rotates the shaft 30 relative to the cam member 27 which is held from such fast rotation by the drive gear 45 as previously described until the pointer 37 on the end face 36 of the shaft 30 is pointing to the "cook" section 56 of the dial 48 as illustrated in FIG. 2. In this manner, it can be seen from FIG. 6 that the cut out 55 in the cam section 53 of the unlatching member 28 is adjacent the rib 54 of the cam part 49 of the cam member 27 so that the natural resiliency of the hinge 50 of the cam member 49 causes the cam member 49 to be in the "in" condition thereof and form part of the continuous cylindrical surface 52 of the cam member 27.

Thus, during continuous rotation of the cam member 27 by the drive pinion 45 being rotated by the timer motor 45', the free end 64 of the switch blade 60 bears against the surface 52 in the condition of FIG. 3 so that the switch 54 remains continuously closed during the rotation of the member 27 through all of the revolutions thereof for the desired cooking time for the oven 22 whereby the power element 23 thereof will be in a continuous "on" condition to provide for the continuous cooking operation, the unlatching member 28 remaining in the selected position of FIG. 2 with the cam member 27 and rotating in unison therewith through the interlocking relation of the gear teeth 42 and 41.

When the operator desires to provide a defrost cycle for the oven 22 wherein the power unit 23 is to be repetitively turned on for a certain period of time and then turned off for a certain period of time to accomplish a pulsed thawing operation of frozen food placed in the oven 22, the operator turns the unlatching member 28 by its shaft 30 relative to the cam member 27 through the ratcheting arrangement of the gear teeth 41 and 42 and the compression of its spring 38 as previously described whereby the pointer 37 is pointing to the "defrost" section 57 of the dial 48 as illustrated in FIG. 7.

By positioning the indicator 37 of the shaft 30 to the portion of the "defrost" section 57 of the dial 48 that indicates "slow" thereon, the amount of "on" time of the power unit 23 will be less than the amount of "on" time of the power unit 23 if the pointer 37 is pointing toward the "fast" portion of the "defrost" section 57 of the dial 48 as will be apparent hereinafter. Of course, the pointer 37 can be positioned anywhere inbetween the "slow" and "fast" portions to provide for "on" time of the power unit 23 intermediate the slow and fast operations thereof. In fact, it will be realized that the adjustment of the shaft 30 is infinitely variable between the "slow" and "fast" portions of the "defrost" section when selecting the desired percentage of on time of the power unit 23 which can be from approximately 30 percent "on" to approximately 100 percent "on" when the indicator 37 of the shaft 30 is pointing to the "cook" section 56 of the dial plate 48.

In any event, when the indicator 37 is pointing to some portion of the "defrost" section 57 of the indicator dial plate 48, the cam portion or section 53 of the unlatching member 28 is now in engagement against the rib 54 of the cam part 49 of the cam member 27 and holds the same in the out condition of FIG. 8 during the continuous rotation of the cam member 27 by the timer gear 45.

Accordingly, the switch 24 remains closed in the condition of FIG. 8 until the cam part 49 is rotated against the blade 60 as illustrated in FIG. 9 to cause the blades 59 and 60 to move to the left so that the end 78 of the blade 59 moves to the left beyond the angled surface 77 of the latching projection 76 of the latch member 70 to thereby permit the stored energy in the leaf portion 73 of the latch member 70 to rotate the latching member and arm 74 thereof downwardly and insert the projection 76 between the free ends 63 and 64 of the switch blades 59 and 60 as illustrated in FIG. 9 even though the contacts 61 and 60 are remaining in electrical contact with each other as illustrated in FIG. 9 at this time.

However, once the cam part 49 is rotated past the free end 64 of the switch blade 60 from the position of FIG. 9 toward the position of FIG. 10, the switch blade 60 is adapted through its natural resiliency to move back toward the surface 52 of the cam member 27 as illustrated in FIG. 10. However, the switch blade 59 cannot follow such movement as the free end 63 of the switch blade 59 now engages against the back surface 79 of the latching projection 76 as illustrated in FIG. 10 whereby the switch 24 is now latched in an open condition thereof and turns off the power unit 23.

Figure 11:
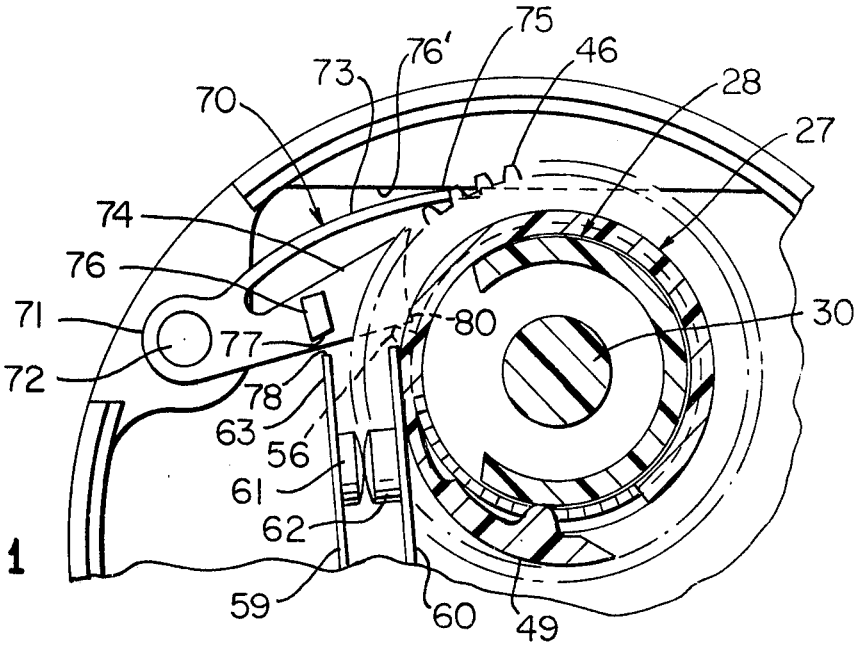
FIG. 11 is a view similar to FIG. 10 and illustrates the switch construction in another operating condition thereof for the setting of FIG. 7.

The switch 24 remains in the open condition of FIG. 10 until the unlatching tongue 56 on the unlatching member 28 rotates and engages against the arm 74 of the latch member 70 in the manner illustrated in FIG. 11 and cams the latch member 70 in a counter clockwise rotational direction about its post 72 and in opposition to the bowing of the arm 73 to cause the latch projection 76 to clear the end 78 of the switch blade 59 and thereby permit the natural resiliency of the switch blade 59 to move the same to the right in FIG. 11 and again place its contact 51 against the contact 52 of the switch blade 60 and thereby close the switch 24. Subsequently, the cam tongue 56 of the unlatching member 28 moves beyond the free end 80 of the arm 74 of the latch member 70 to permit the latch member 70 and its arm 74 to move downwardly under the force of the stored spring energy in the bowed arm 73. However, at this time, the surface 77 of the projection 76 of the latch member 70 now engages against the end 78 of the switch blade 59 as illustrated in FIG. 8 so that the switch 24 remains closed until the cam part 49 is rotated against the switch blade 60 to cause the switch 24 to be latched into the open condition in the manner previously described.

Accordingly, it can be seen that for each revolution of the cam member 27, the switch 24 will be in a closed condition during a certain percentage of the increment of time of one revolution of the cam member 27 and will be in an open condition during the remainder of the increment of time of one revolution of the cam member 27.

Thus, should the timer motor 45' be arranged to drive the cam member 27 one complete revolution every minute, during a defrost setting, a certain percentage of that minute will be with the power element 23 in an "on" condition thereof and the remainder of that minute will be with the power element 23 in the "off" condition thereof, such percentages being determined by the relationship of the tongue 56 of the unlatching member 28 relative to the cam part 49 of the cam member 27 and such relationship being determined by setting the unlatching member 28 relative to the cam member 27 through manual rotation of the shaft 30 by a suitable control knob thereon.

In this manner, the rotational position of the selector shaft 30 of the unlatching member 28 relative to the cam member 27 can provide for a variable percentage of the "on" time for the switch 24 for approximately 30 percent on and 70 percent off to approximately 100 percent on time. Thus, in the above example, when the selector 37 is set for "fast" defrost, the "on" time will be approximately 45 seconds and the "off" time will be approximately 15 seconds for each minute of operation of the oven 22 as the cam member 27 will make one revolution in one minute according to this example. This setting could also be used for a slow cook operation of the oven 22 if desired or the switch construction 21 can be set for a continuous "on" cooking operation in the manner previously described by having the cam member 49 in the position of FIG. 6 where the switch 24 remains closed during all of the rotation of the cam member 27 for the reasons previously set forth.

While the switch construction 21 has been described in connection with the microwave oven 22, it is to be understood that the switch construction 21 with the timer motor 41 could provide a variable on time switch for other structures. Also, a timer could be connected to drive the cam member 27 so that a time variable power switch would be provided by this invention.

Accordingly, it can be seen that this invention not only provides an improved switch construction and method of making the same, but also this invention provides an improved microwave oven system utilizing such a switch construction.

While the forms and methods of this invention, now preferred, have been illustrated and described as required by the Patent Statute, it is to be understood that other forms and method steps can be utilized and still fall within the scope of the appended claims.

What is claimed is:

1. In an electrical switch construction having an electrical switch provided with different operating conditions and having means operatively associated with said switch for causing said switch to be repetitively in one condition thereof a certain percentage of a certain increment of time and for being in another condition thereof for the remainder of said certain increment of time, said means being adapted for selecting the amount of said certain percentage of said certain increment of time within certain limits, said means including a rotatable cam member having a cam part for camming said switch to one of said operating conditions thereof during each revolution of said cam member, the improvement wherein said cam part of said cam member is radially movable relative thereto, said means being adaptable for selecting a radial position of said cam part for camming said switch or a radial position of said cam part that will not cam said switch.

2. An electrical switch construction as set forth in claim 1 wherein said means is infinitely variable in the selection of said certain percentage.

3. An electrical switch construction as set forth in claim 1 wherein said means is adapted for selecting a continuous operating condition of said switch.

4. An electrical switch construction as set forth in claim 1 wherein said cam part is integral with said cam member so that said cam member and said cam part comprise a one-piece structure.

5. An electrical switch construction as set forth in claim 4 wherein said cam part of said cam member is hinged to said cam member by a hinge section of said cam member that has a natural resiliency to hold said cam part radially inwardly.

6. An electrical switch construction as set forth in claim 1 wherein said means includes a latch for holding said switch in said cammed position thereof each time said cam part cams said switch to that operating condition thereof.

7. An electrical switch construction as set forth in claim 6 wherein said means includes a rotatable unlatching member for operating said latch each revolution of said unlatching member to cause said switch to be unlatched from said cammed operating condition thereof to return to the other operating condition thereof.

8. An electrical switch construction as set forth in claim 7 wherein said cam member and said unlatching member are arranged to rotate about the same axis and respectively have interconnecting structure cooperating together to cause said cam member and said unlatching member to rotate in unison, said means being adapted to adjust the relative positions of said cam member and said unlatching member to thereby select said certain percentage.

9. An electrical switch construction as set forth in claim 8 wherein said switch comprises a pair of switch blades having a normal bias to place said blades together to provide one of said operating conditions of said switch, said cam part camming both of said blades to the other of said operating conditions where said latch holds one of said blades in said cammed position thereof, said latch being adapted to hold said one blade in said cammed position thereof while the other blade is adapted to move back to its uncammed position when said cam part is rotated by said cam member away from said blades.

10. An electrical switch construction as set forth in claim 8 wherein said unlatching member has a cam surface thereon which is adapted to move said cam part of said cam member to its said camming position when said unlatching member and said cam member are in certain rotational positions relative to each other.

* * * * *